US006878224B1

(12) United States Patent
Focke et al.

(10) Patent No.: US 6,878,224 B1
(45) Date of Patent: Apr. 12, 2005

(54) METHOD FOR PRODUCING (CIGARETTE) PACKETS

(75) Inventors: Heinz Focke, Verden (DE); Henry Buse, Visselhövede (DE)

(73) Assignee: Focke & Co., Verden (DE)

( * ) Notice: Subject to any disclaimer, the term of this patent is extended or adjusted under 35 U.S.C. 154(b) by 181 days.

(21) Appl. No.: 10/069,074

(22) PCT Filed: Aug. 17, 2000

(86) PCT No.: PCT/EP00/08020

§ 371 (c)(1),
(2), (4) Date: Feb. 21, 2002

(87) PCT Pub. No.: WO01/14221

PCT Pub. Date: Mar. 1, 2001

(30) Foreign Application Priority Data

Aug. 24, 1999 (DE) ..... 199 40 138

(51) Int. Cl.[7] ..... B31F 1/00
(52) U.S. Cl. ..... 156/204; 156/226
(58) Field of Search ..... 156/204, 226, 156/227

(56) References Cited

U.S. PATENT DOCUMENTS 1,973,391 A 9/1934 Reynolds
3,804,235 A * 4/1974 Anderson ..... 206/497
3,862,713 A * 1/1975 Froehlig ..... 229/154
4,003,467 A 1/1977 Focke et al.
4,770,320 A * 9/1988 Miles et al. ..... 221/33
5,427,235 A 6/1995 Powell et al.
5,762,186 A * 6/1998 Focke et al. ..... 206/245
6,627,033 B1 * 9/2003 Dexter ..... 156/260

FOREIGN PATENT DOCUMENTS

| | | |
|---|---|---|
| DE | 195 29 585 A1 | 3/1996 |
| DE | 196 04 888 A1 | 8/1996 |
| DE | 197 51 484 A1 | 5/1999 |
| DE | 198 15 059 A1 | 10/1999 |
| EP | 745 540 | 6/1995 |
| EP | 747 289 B1 | 5/1996 |
| EP | 947 442 | 10/1999 |
| EP | 947 455 | 10/1999 |

* cited by examiner

*Primary Examiner*—Blaine Copenheaver
*Assistant Examiner*—Barbara J Musser
(74) *Attorney, Agent, or Firm*—Sughrue Mion, PLLC

(57) ABSTRACT

Process for producing (cigarette) packs from blanks which are drawn off from a continuous material web wound as a reel, regions of glue arranged on both sides of the material web serving for connecting folding tabs. The regions of glue are positioned in different lines of the material web such that, in the would state, regions of glue on one side of the material web do not overlap with regions of glue on the other side.

5 Claims, 3 Drawing Sheets

19
21
17
40/41
18
20
38/39
14
12
15
36/37
34/35
42
47/49
11

51/46
16
18
21
19
47/49
42
11
20
34/35
36/37
14
15
12
38/39

Fig.3
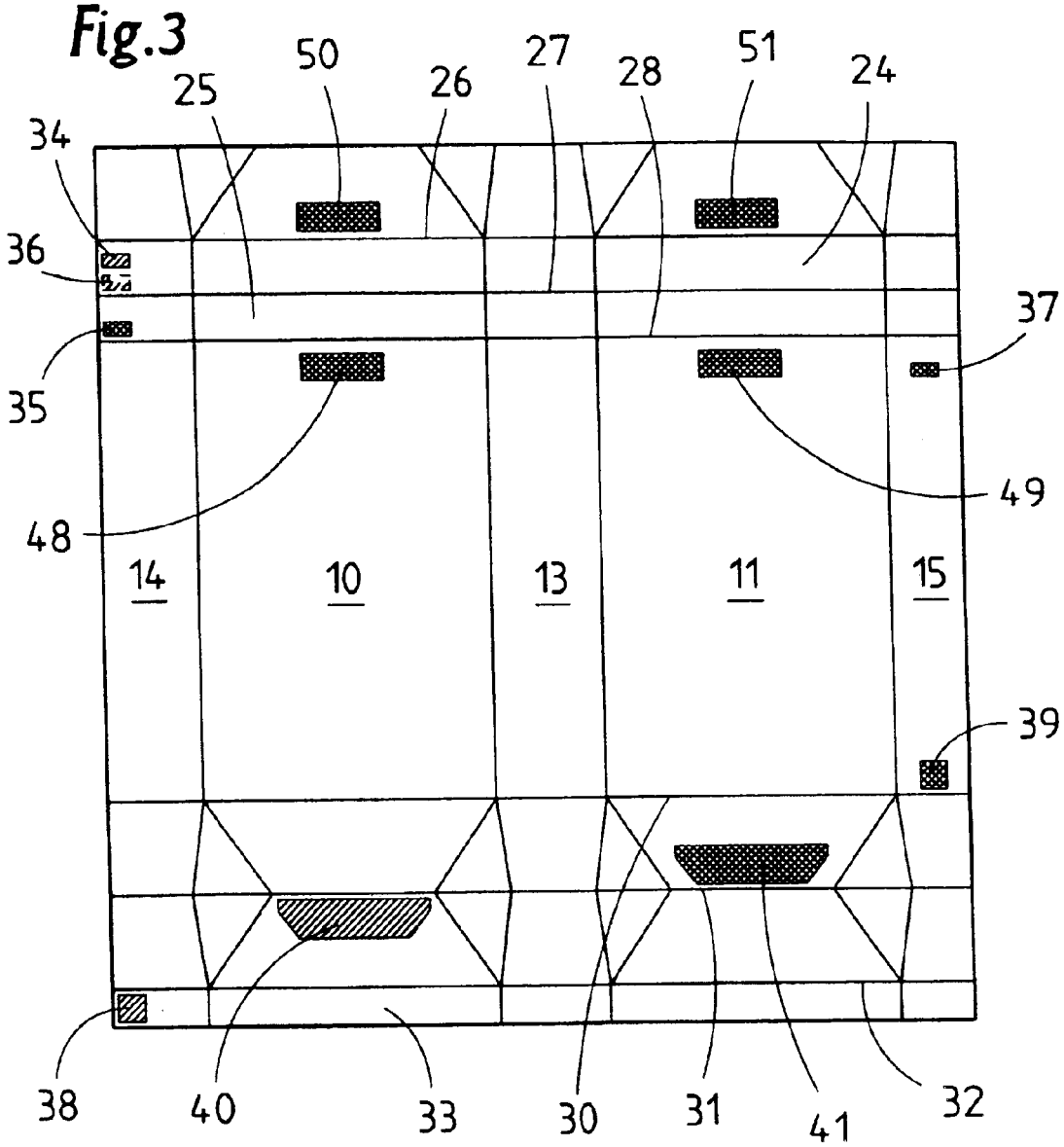
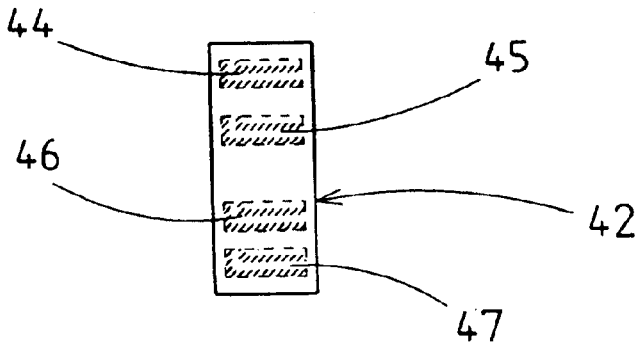
Fig.4

METHOD FOR PRODUCING (CIGARETTE) PACKETS

BACKGROUND OF THE INVENTION

The invention relates to a process for producing (cigarette) packs from blanks which are severed from a continuous material web made of thin packaging material, such as paper, and folded, folding tabs being connected to one another by adhesive bonding.

The adhesive bonding of folding tabs or other parts of the blanks is particularly problematic, in particular, in high-performance packaging machines. If the necessary glue is applied to the blanks in the region of the packaging machine, there is a risk of machine subassemblies becoming contaminated. It has already been proposed for packaging material to be coated with glue of the hot-melt type outside the packaging machine and for the corresponding regions of glue to be activated by the supply of heat once the pack has been completed. Hotmelt adhesive, however, has other disadvantages.

SUMMARY OF THE INVENTION

The object of the invention is to propose measures for the gluing of blanks for (cigarette) packs, in particular made of paper, which make it possible for the disadvantages outlined to be avoided and for gluing to take place outside the packaging machine.

In order to achieve this object, the process according to the invention for producing the packs is characterized by the following features:

a) the material web for the blanks is provided on both sides, in accordance with the folding tabs which are to be connected to one another, with regions of glue, that is to say areas of glue or spots of glue, b) the regions of glue consist of a (cold) glue which (only) in conjunction with a mating area of glue produces the adhesion necessary for connecting the folding tabs or the like, c) the regions of glue are positioned such that, in the wound state of the material web, regions of glue on one side of the material web do not overlap with regions of glue on the other side.

The process according to the invention and the configuration of the blanks for producing, in particular, soft cigarette packs are based on the use of a new type (cold) glue which is known, in principle, in glue technology and, on account of its technical properties, produces the full adhesive action when two corresponding regions of glue, that is to say areas of glue or spots of glue, butt against one another. Without a mating region of glue, an area of glue applied to a blank cannot develop the adhesive action which results in the connection of folding tabs or the like. It is thus possible for material webs provided with regions of glue made of this glue to be wound without the wound layers adhering to one another, the invention avoiding, by virtue of the positioning of regions of glue, the situation where, in the wound web, regions of glue overlap and/or come into abutment against one another. The material web drawn off from the reel is then folded such that the mutually assigned regions of glue or areas of glue either overlap directly or are positioned such that, when a blank produced by the material web is folded, the corresponding regions of glue overlap one another. The corresponding folding may also be carried out, if appropriate, once the blank has been served from the material web.

The process according to the invention can be used particularly advantageously for soft (cigarette) packs corresponding to U.S. Pat. No. 5,762,186. In the case of the type of pack described in said document, it is necessary to connect to one another material strips in the longitudinal direction of the material web and, furthermore, double-layered folding tabs.

The technology according to the invention can also be used when separate blanks are to be connected to one another or to a pack, in particular for the connection of revenue stamps to (soft) packs.

Further details of the invention are explained more specifically below with reference to (cigarette) packs illustrated in the drawings and to blanks and/or parts of material webs. In the figures:

BRIEF DESCRIPTION OF THE DRAWINGS

FIG. 3 shows a spread-out blank for producing a pack according to FIGS. 1 and 2, FIG. 4 shows a separate blank which is to be connected to the pack, that is to say a revenue stamp.

DETAILED DESCRIPTION OF THE INVENTION

Figure 5:
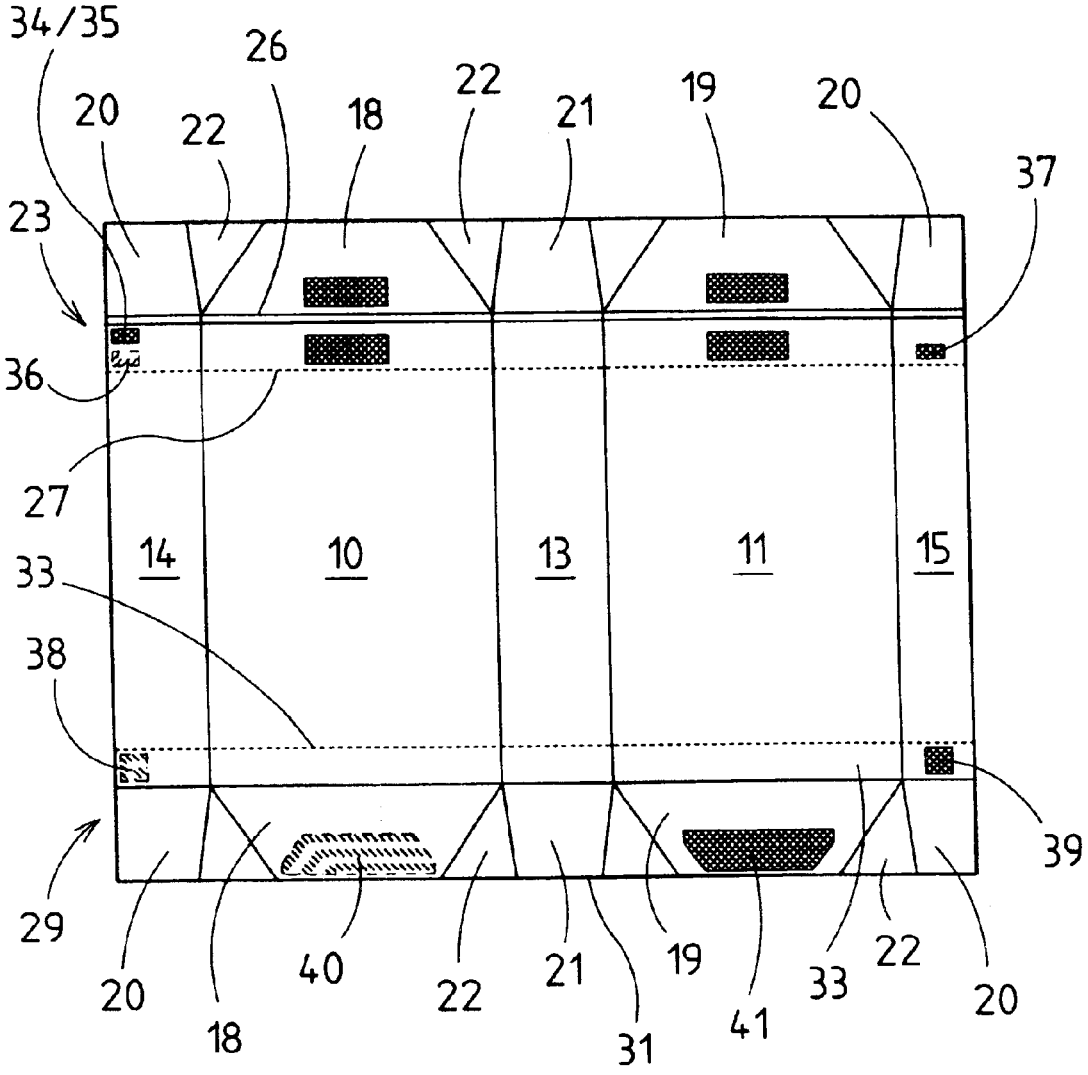
FIG. 5 shows the blank according to FIG. 3 in an intermediate folding position.

The drawings illustrate, as the preferred use example, the configuration of a soft pack for cigarettes which is described and illustrated in detail in U.S. Pat. No. 5,762,186. The pack according to FIGS. 1 and 2 comprises a blank made of paper or similar packaging material (FIGS. 3 and 5).

The cuboidal pack forms a front wall 10, an opposite, rear wall 11 and narrow, upright side walls 12 and 13. The side wall 13 is positioned within the blank (FIG. 3) between the front wall 10 and rear wall 11. The side wall 12 comprises two strip-like wall tabs 14, 15 which overlap one another and are connected to one another by adhesive bonding.

An end wall 16 and a base wall 17 each comprise a plurality of folding tabs which partially overlap one another, to be precise in this case in accordance with the principle of envelope folding. The end wall 16 comprises two trapezoidal longitudinal tabs 18, 19 which respectively adjoin the front wall 10 and rear wall 11. Said longitudinal tabs overlap sub-regions of side tabs 20, 21 connected to the side walls 12, 13. Said side tabs,, in turn, are connected to the associated longitudinal tabs 18, 19 via triangular gussets 22 (FIG. 5).

In this pack example, the base wall 17 is designed analogously to the end wall 16, with the result that the folding tabs of the base wall 17 are correspondingly provided with the same designations.

Adjacent to the end wall 16, that is to say directly beneath the same, the pack or the blank is provided with a double fold running all the way round, to be precise with a Z-fold 23. Said fold comprises two mutually overlapping folding strips 24, 25 of the original blank (FIG. 3). Said folding strips are separated off from one another by parallel folding line 26, 27, 28. The Z-fold 23 is formed, in the region of the blank, such that the originally bottom folding line 28 forms a top, outer folding border of the Z-fold 23, while the central folding line 27, concealed, forms the bottom boundary of the Z-fold 23. The folding line 26 is the transition from the upright pack walls into the end wall 16.

Furthermore, the region of the base wall 17 is designed in a specific manner. The blank forms a double-layered base strip 29 here. For this purpose, the blank is also provided in the base region with three parallel folding lines 30, 31, 32 which belong to the base strip 29. The blank or the material web is folded over along the central folding line 31 to produce the double-layered base strip 29. The latter is wider than the corresponding dimensions of the base-side folding tabs, with the result that a double-layered reinforcing strip 33 extends in the region of the upright pack walls. The entire surface area of the folding tabs 18, 19, 20, 21, 22, which form the base wall 17, is formed from two layers of the blank.

In order to form a pack from a blank designed in the manner described (FIG. 5), a plurality of glue connections are required. These are provided by rectangular, square or more or less trapezoidal areas of glue. For the latter, use is made of a specific glue which produces the necessary adhesive action when correspondingly positioned areas of glue of blank parts which are to be connected abut one another. Said glue is a specific cold glue, whereby the mutually assigned glue areas furnish the adhesive bond by abutting or pressing against one another. The corresponding glue areas may have different matching components.

In order to avoid with all certainty that an adhesive bond is made with the material web, in particular a paper web in the region of the glue areas, the latter is expediently provided with a glue-resistant coating on its top surface. In addition—or as an alternative—the glue areas can be provided with an external coat which deliberately excludes any adhesive bonding with the material web.

With the present configuration of the pack, a non-folded material web, for forming blanks according to FIG. 3, is provided in the correct positions with the areas of glue illustrated. In this case, the blanks are connected to one another within the material web (not shown) via the wall tabs 14, 15. The material web designed in this way is wound into a reel. The material web is drawn off from the latter and then folded, with the Z-fold 23 or the double-layered base strip 29 being formed in the process. Thereafter, the blanks according to FIG. 5 are severed from the material web.

In the original state, that is to say in the planar state according to FIG. 3, the material web is provided with regions of glue which have the technical properties described.

(Small) areas of glue 34 and 35 are provided for the purpose of connecting the two legs of the Z-fold 23, that is to say the two folding strips 24, 25. Said two regions of glue are located on the same side of the material web or of the blank, that is to say on the (printed) front side. The different markings (hatching and crosshatching) show that the two areas of glue 34, 35 are connected to one another, that is to say overlap one another once the folding strips 24, 25 have been folded (FIG. 5). For this purpose, the area of glue 34 is positioned adjacent to the folding line 26 and the area of glue 35 is positioned adjacent to the folding line 28.

For the purpose of connecting the wall tabs 14, 15 to one another, areas of glue 36, 37 are provided in the top region adjacent to the end wall 16 and areas of glue 38, 39 are provided at the bottom adjacent to the base wall 17, in each case in relation to the blank according to FIG. 5 which has been prepared for forming the packs. The mutually assigned (rectangular) areas of glue 36, 37 are positioned on different sides of the blank, that is to say on the (non-printed) inside in the region of the wall tab 14 and on the outside of the wall tab 15. By virtue of the Z-fold 23, the areas of glue 36, 37 in the original position (FIG. 3) are offset in relation to one another in the longitudinal direction of the blank or of the material web. The area of glue 36 is located in the region of the folding strip 24. The area of glue 37 is arranged beneath the Z-fold 23 and/or beneath the folding line 28. By virtue of the Z-fold 23, the two areas of glue 36, 37 move to the same level or into the same (imaginary) transverse plane (FIG. 5). The dashed circumference line and hatching of the area of glue 36 shows that the latter is positioned on the non-visible inside of the blank. When the wall tabs 14, 15 overlap, the areas of glue 36, 37 are located congruently one upon the other.

Similarly, the areas of glue 38, 39 in the original state, that is to say in the region of the non-folded blank according to FIG. 3 or a corresponding material web, are positioned in offset lines or planes of the material webs. The area of glue 38, which is assigned to the (outer) wall tab 14, is arranged on the outermost border of the blank in the region of the reinforcing strip 33. The other area of glue 39 is located in the region of the wall tab 15 above the folding line 30. The two areas of glue 38, 39 are originally positioned (FIG. 3) on the same side of the blank or of the material web. By virtue of the outlined folding for the purpose of forming the base strip 29, the areas of glue 38, 39 move into a mutually aligned position (FIG. 5), to be precise on the relevant sides for the gluing.

Figures 1, 2:
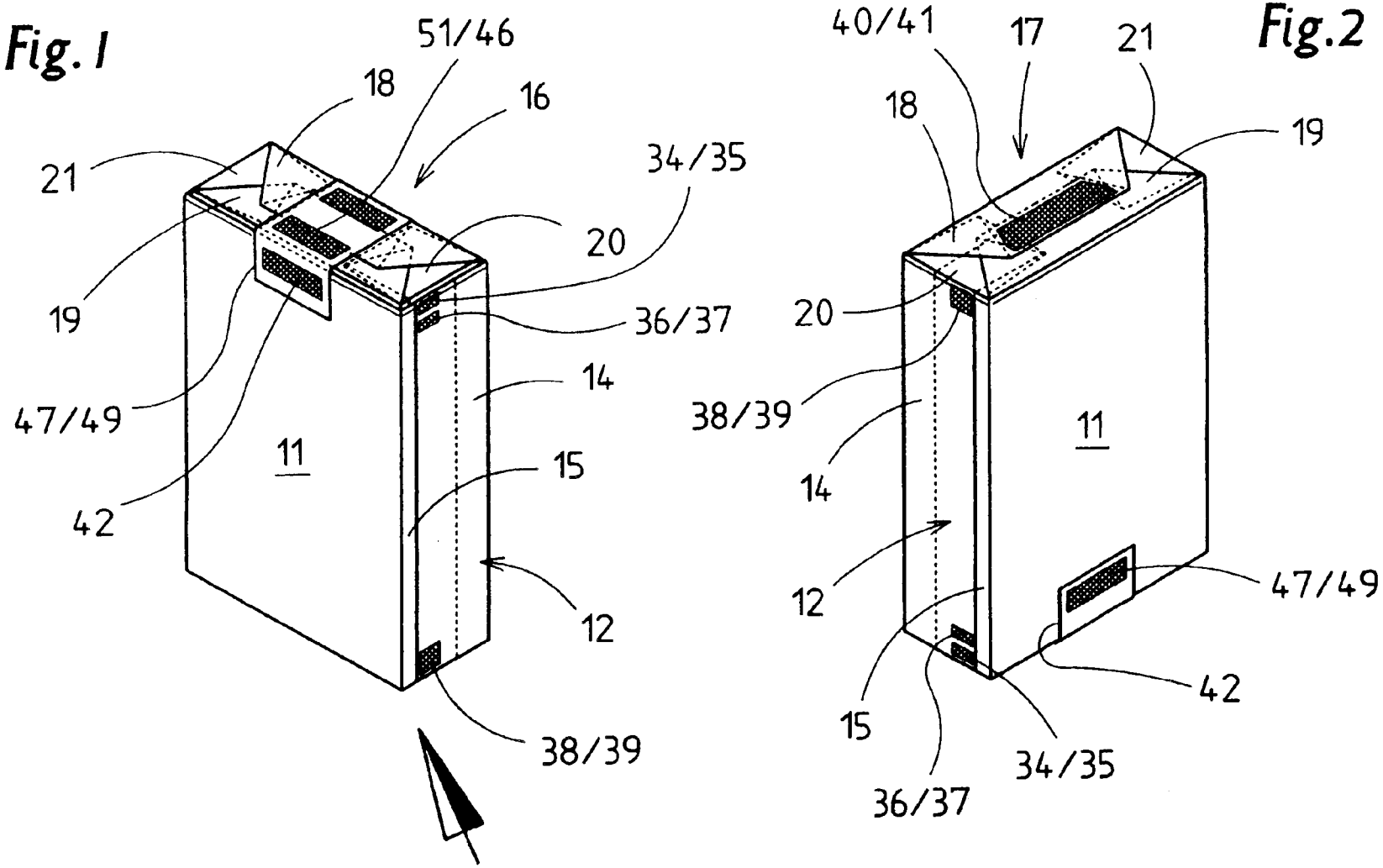
FIG. 1 shows a perspective view of a soft (cigarette) pack.
FIG. 2 shows a bottom view of the pack according to FIG. 1, that is to say with a view of a bass wall.

For the purpose of connecting the (double-layers) longitudinal tabs 18, 19 of the base wall 17 to one another, more or less trapezoid-contoured strips of glue 40, 41 are provided, as regions of glue, in the region of the reinforcing strip 33. The two strips of glue 40, 41 are located on different sides of the (central) folding line 31 of the reinforcing strip 33, to be precise directly adjacent to said folding line 31. the strips of glue 40, 41 are originally arranged on the same side of the blank or material web (FIG. 3), that is to say on the front side. Once the reinforcing strip 33 has been folded along the folding line 31, the two strips of glue 40, 41 are moved into the same (imaginary) transverse plane of the blank (FIG. 5). The reinforcing strip 3 is folded such that insides of the two layers butt against one another. This means that, once the base strip 29 has been produced, the strip of glue 40 and the strip of glue 41 are located on different sides. The two strips of glue 40, 41 are then located in a position in which, when the longitudinal tabs 18, 19 are folded for the purpose of forming the base wail 17, the strips of glue 40, 41 overlap one another (FIG. 2).

Accordingly, a special feature is that, in the region of the wound, original material web, the mutually corresponding regions of glue are located in different planes or lines (as seen in the longitudinal direction of the material web). By virtue of the material web being folded once it has been drawn off from the reel, the areas of glue move into the correct position for the production of the pack, taking account of the outside and inside of the blanks. The individual blanks are severed from the material web folded in this way. The configuration and arrangement of the regions of glue described may also be used for fixing separate blanks. The example given in the drawings is the fastening of a conventional revenue stamp 42. This is a rectangular, strip-like blank, usually made of paper, which is positioned transversely over the end wall 16 of the pack, legs 43 being fastened on the front wall 10 and rear wall 11.

The special feature is that the revenue stamp is provided on the rear side—the side directed towards the pack—with regions of glue which correspond with appropriately arranged regions of glue on the pack or on the blank, with the result that the revenue stamp 42 is fastened on the pack with the aid of regions of glue which overlap one another. In the present case, the revenue stamp is provided with four regions of glue or areas of glue 44, 45, 46, 47. These correspond to appropriately formed and arranged areas of glue 48, 49, 50, 51 on the blank or on the pack. In the region of the pack or of the blank, in each case one area of glue 48, 49 is provided in the region of the front wall 10, on the one hand, and rear wall 11, on the other hand, to be precise beneath the folding line 28, which forms a top border of the finished pack. The other areas of glue 50, 51 are located in the region of the longitudinal tabs 18, 19 of the end wall 16. This makes it possible for the revenue stamp 42 to be fastened such that said revenue stamp is fastened by means of two regions of glue in the region of the end wall 16, that is to say by means of the areas of glue 45, 46 of the revenue stamp 42 and the areas of glue 50, 51 of the longitudinal tabs 18, 19. In the region of the front wall 10 and rear wall 11, the area of glue 44 and 47 of the revenue stamp are connected to the areas of glue 48 and 49.

List of Designations

10 Front wall
11 Rear wall
12 Side wall
13 Side wall
14 Wall tab
15 Wall tab
16 End wall
17 Base wall
18 Longitudinal tab
19 Longitudinal tab
20 Side tab
21 Side tab
22 Gusset
23 Z-fold
24 Folding strip
25 Folding strip
26 Folding line
27 Folding line
28 Folding line
29 Base strip
30 Folding line
31 Folding line
32 Folding line
33 Reinforcing strip
34 Area of glue
35 Area of glue
36 Area of glue
37 Area of glue
38 Area of glue
39 Area of glue
40 Strip of glue
41 Strip of glue
42 Revenue stamp
43 Leg
44 Area of glue
45 Area of glue
46 Area of glue
47 Area of glue
48 Area of glue
49 Area of glue
50 Area of glue
51 Area of glue

What is claimed is:

1. A process for producing packs from blanks which are folded around solid contents of each pack, with folding tabs thus formed being connected to one another by glue, said process comprising the steps of:

a) for producing the blanks, providing a longitudinal material web, on both opposite sides thereof and in accordance with folding tabs which are to be connected to one another, with regions of glue, in the form of glue areas (34 . . . 39; 48 . . . 51), and then winding up the web to form a wound reel, b) choosing the glue regions to consist of a glue which, only when in contact with a corresponding mating glue area, produces adhesion necessary for connecting the folding tab, but which does not adhere directly to the material web, c) positioning the glue regions so that, in the wound material web, the glue regions on one of said opposite sides of the material web do not overlap the glue regions on the other of said opposite sides of the material web, d) drawing off the material web from the reel, e) severing the blanks, for producing the packs, from the drawn off material web, and folding each blank around the pack contents to form the folding tabs, and f) arranging the glue regions so that mutually assigned glue regions, for connecting the folding tabs, lie against one another only after the blank has been folded around the pack contents.

2. The process according to claim 1, characterized in that at least the glue regions and/or the material web are provided with a coating which reduces adhesive action of the glue directly on the material web.

3. The process according to claim 1, characterized in that the glue regions arranged on the one side of the material web are offset in a transverse direction in relation to the glue regions arranged on the opposite side of the material web.

4. The process according to claim 1, characterized in that, after the material web, provided with the glue regions on said both sides, is drawn off from the reel, the material web is transversely folded continuously in the longitudinal direction, with a Z-fold (23) and/or a double-layered base strip (29) being formed, the transverse folding of the material web resulting in offset glue regions, which are assigned to one another, being positioned relative to one another such that, when folded, subsequently severed blanks have overlapping glue regions for the folding tabs.

5. The process according to claim 1, characterized in that a separate revenue stamp (42) is connected to each pack by respective regions of glue arranged on a pack front wall (10), a pack, real wall (11) and a pack end wall (16), on one hand, and by corresponding regions of glue arranged on an inside of the revenue stamp (42), on the other hand.

* * * * *